US008028804B2

(12) United States Patent
Lair

(10) Patent No.: US 8,028,804 B2
(45) **Date of Patent: *Oct. 4, 2011**

(54) AUTOMATIC LADDER FOR ATTIC ACCESS

(75) Inventor: Jean-Pierre Lair, San Antonio, TX (US)

(73) Assignee: Jean-Pierre Lair, San Antonio, TX (US)

( * ) Notice: Subject to any disclaimer, the term of this patent is extended or adjusted under 35 U.S.C. 154(b) by 935 days.

This patent is subject to a terminal disclaimer.

(21) Appl. No.: 11/938,921

(22) Filed: Nov. 13, 2007

(65) Prior Publication Data

US 2008/0060874 A1 Mar. 13, 2008

Related U.S. Application Data

(63) Continuation-in-part of application No. 11/671,925, filed on Feb. 6, 2007, now Pat. No. 7,841,448.

(60) Provisional application No. 60/765,766, filed on Feb. 6, 2006.

(51) Int. Cl.
*E06C 9/06* (2006.01)

(52) U.S. Cl. ..... 182/77; 182/78

(58) Field of Classification Search ..... 182/77, 182/78, 79, 80, 95, 97, 98, 99, 208
See application file for complete search history.

(56) References Cited

U.S. PATENT DOCUMENTS

| | | | | |
|---|---|---|---|---|
| 1,724,824 | A * | 8/1929 | Charles | 182/79 |
| 1,811,707 | A | 6/1931 | Bessler | |
| 1,811,708 | A | 6/1931 | Bessler | |
| 1,811,820 | A | 6/1931 | Bessler | |
| 1,858,981 | A | 5/1932 | Bessler | |
| 1,867,904 | A | 7/1932 | Bessler | |
| 1,930,992 | A | 10/1933 | Bessler | |
| 1,936,929 | A * | 11/1933 | Bessler | 182/80 |
| 2,203,086 | A * | 6/1940 | Garner | 182/80 |
| 2,593,336 | A | 4/1952 | Nixon | |
| 2,907,401 | A * | 10/1959 | Wagner | 182/78 |
| 3,789,955 | A | 2/1974 | Knapp | |
| 6,349,793 | B1 * | 2/2002 | Kincaid | 182/69.4 |
| 6,802,392 | B1 | 10/2004 | Davis | |
| 6,866,118 | B1 * | 3/2005 | Battenberg | 182/77 |
| 6,886,661 | B1 | 5/2005 | Battenberg | |
| 6,962,236 | B2 | 11/2005 | Penn | |

(Continued)

OTHER PUBLICATIONS

SpaceLift, Raising Storage to a Higher Level, "SpaceLift 6000 Site Selection".

(Continued)

*Primary Examiner* — Katherine Mitchell
*Assistant Examiner* — Daniel Cahn
(74) *Attorney, Agent, or Firm* — Thompson & Knight LLP; James J. Murphy

(57) ABSTRACT

An access panel is shown in the present invention to provide easy and safe access to an attic space or elevated structure. The access panel is fully automatic. During opening, the access panel uses an energizing motor to control the gravitational forces for opening a cover and deploying ladder sections. During closing, the access panel is energized to retract the ladder sections and close the access panel. The motor is energized to close the access panel until a stow latch engages to stow the access panel during non-use. A safety switch is mounted inside the attic space to allow a user to open the panel and extend the ladder should the user be trapped in the attic space.

36 Claims, 8 Drawing Sheets

U.S. PATENT DOCUMENTS

| | | | | |
|---|---|---|---|---|
| 7,140,466 | B2 * | 11/2006 | Penn | 182/77 |
| 7,841,448 | B2 * | 11/2010 | Lair | 182/77 |

OTHER PUBLICATIONS

Easy Attic Access, This Old House. http://www.unsoldhouse.com/ton/knowhow/adding/article/0,16417,21.., pp. 2-3, Nov. 17, 2005.
Stairs That Disappear, This Old House. http://www.unsoldhouse.com/ton/knowhow/tools/article/01417.104..., pp. 2-3. Nov. 17, 2005.
2006 International Builders Show, Precision Ladders, LLC.
SpaceLift, Raising Storage to a Higher Level, "Convenient Home Storage Is Looking Up", 2006 Spacelift Products, Inc.
"Fire-Rated Ceiling Access Dor With Integral Folding Stairway", Precision Ladders, LLC.
"Super Simplex Disappearing Stairway", Precision Ladders, LLC.
"Precision Super Simplex Disappearing Stairway", Precision Ladders, LLC. Jul. 14, 2004.

* cited by examiner

AUTOMATIC LADDER FOR ATTIC ACCESS

CROSS REFERENCE TO RELATED APPLICATIONS

This is a continuation-in-part patent application of U.S. Utility application Ser. No. 11/671,925 filed Feb. 6, 2007 now U.S. Pat. No. 7,841,448, which claims priority to U.S. Provisional Application 60/765,766, filed Feb. 6, 2006, both of which are incorporated herein by reference.

BACKGROUND OF THE INVENTION

1. Field of the Invention

The present invention relates to an automatic retractable ladder that is installed on an access panel hinged on a framing structure that surrounds an opening into the ceiling for access to an attic space. The access panel and the retractable ladder have two positions. In the first position the access panel automatically closes the opening into the ceiling and the retractable ladder is stowed or retracted on top of the access panel, i.e. in the attic. In the second position the access panel automatically uncovers the opening of the ceiling and the retractable ladder automatically deploys or extends to reach the ground. The automatic opening of the access panel and the automatic deploying of the retractable ladder are achieved through gravity, wherein the rate of deployment is controlled with the assistance of a motorized apparatus. The automatic closing of the access panel and the automatic stowing of the retractable ladder are achieved through the motorized apparatus. The latching of the access panel in its closed position is achieved automatically and mechanically.

2. Description of the Related Art

Ladders for attic access are widely used by the people in their private homes. Attic accesses are usually provided above the garages and/or living quarters of private homes. The most common attic access consists of an access panel, spring loaded in the closed position and hinged on a wooden structure frame surrounding an opening in the ceiling and installed in the ceiling. To get access to the attic, a user would pull on a piece of rope attached to the panel and hanging therefrom. This opens the panel, giving access to a folded ladder. The ladder is usually composed of three sections that are folded on top of each other and hinged between each other. The first section is attached to the panel. To deploy the ladder, a user needs to manually grasp the folded second and third sections, rotates this assembly to the deployed position and finally grasp the third section to manually unfold it from the second section. Once the unfolding is achieved, the three sections of the ladder are usually extended in alignment enabling a user to access the attic space. The opposite process needs to be followed by the user for the refolding of the ladder. For re-closing the panel, the user needs to push firmly on the panel moving the panel up to a couple of inches from the ceiling. At such point the springs of the panel take over and move the panel to its fully closed position.

The experience shows that the drawbacks of these attic access systems reside in the difficulty of the steps that need to be performed for the opening of the panel, i.e., the unfolding of the ladder, the refolding of the ladder and the re-closing of the panel. While the procedure appears to be easy for a male, provided he is tall, strong and not impaired, the procedure is difficult for a female and virtually impossible as well as potentially dangerous to any elderly person.

U.S. Pat. No. 6,866,118 describes a ladder that can be extended and retracted by an electric motor. While the technology described appears to be an improvement over the manual attic ladders mentioned previously, its complexity makes it impracticable and too costly for industrial or private home applications.

It would consequently be of great advantage to provide a system giving easy and safe attic access to everyone at a low cost.

BRIEF SUMMARY OF THE INVENTION

The present invention overcomes the drawbacks of the prior art by providing a fully automatic access to an attic. More particularly, the invention is composed of an access panel that is hinged towards the forward end of a frame structure that supports sections of ladders. The frame structure supports in its aft end part of the mechanism that unlatches the panel, controls its opening, controls the deployment of the sections of ladders, retracts the ladder and closes the panel and re-latches it on the fixed frame. More particularly, while the invention uses gravity for the opening of the panel and for the extension of the sections of ladders, it uses a single electric motor mounted at the aft end of the framing structure for (a) controlling the rate of deployment of the sections of ladders, and (b) performing the retraction of the ladders and the closing of the panel.

The stow latch performs the function of maintaining the panel and its associated sections of ladders in the closed position.

The gears of the single electric motor performs the function of controlling the opening of the panel and the extension of the sections of ladders to the ground.

The single electric motor performs three distinct functions. The first function is to control the rate of deployment of the sections of ladders. The second function is to retract the sections of ladders to their stowed position after they have been extended to the ground, and the third function is to close the panel.

In one embodiment of the invention, there is one electric solenoid for controlling the unlatching of the stow latch. The stow latch is equipped with a manual override.

In another embodiment of the invention, the unlatching of the stow latch is only achieved manually.

It is a characteristic of this invention that the electric motor is energized in a lowering direction to extend the sections of the ladders. The electric motor is equipped with gears that control the rate of lowering the ladder sections by gravity and the raising and stowing of the ladder sections. The shaft of the present invention is equipped with a free wheel that is equipped with a sprocket mechanism. A chain connects the gears of the electric motor to the free wheel to allow the free wheel to rotate in either a raising or lowering direction. Two reels are attached to the distal ends of the shaft, wherein one end of the cables is rolled up on, and attached to each of the reels. The other extremity of the cables is attached to the last section of the ladder. In the lowering direction, the arrangement of the gears of the electric motor and the rotation of the gears by the electric motor control the speed of rotation of the free wheel. Gravity alone drives the reels and the shaft to rotate and unroll the cables. Although the wheel of the shaft is free to rotate in the lowering direction of the ladder apparatus, its rotational speed is controlled, via the chain, by the gearing arrangement of the electric motor. As indicated above, it is gravity alone that drives the shaft in the lowering direction of the apparatus. The shaft is the force that drives the free wheel via the sprocket mechanism. Since the electric motor controls the rotational speed of the free wheel, the free wheel in turn controls the rotational speed of the shaft. Thus, the ladder sections deploy as a controlled fall rather than a free fall.

The electric motor is energized to rotate the gears in an opposite, raising direction, thereby causing the free wheel to correspondingly rotate in a raising direction. This in turn causes the reels to rotate in a direction to roll up the cables, thereby retracting the ladder sections and closing the panel by raising the panel to a position that engages the stow latch with the latch receptacle.

The ladder of the invention is at least composed of two distinct sections that are engaged in a sliding arrangement. Depending of the height of the ceiling, the number of sections can be increased. The figures accompanying the detailed description of the invention show three sections of ladders. The first ladder section is mechanically attached to the access panel, the second ladder section is arranged to slide on top of the first ladder section, and the third ladder section is arranged to slide on top of the second ladder section. Mechanical stops are provided on each of the ladder sections for limiting the sliding stroke.

The invention, in accordance with preferred and exemplary embodiments, together with further objects and advantages thereof, is more particularly described in the following detailed description taken in conjunction with the accompanying drawings.

DETAILED DESCRIPTION OF THE INVENTION

In the following detailed description, reference is made to the accompanying drawings, which form a part hereof and are shown to illustrate specific embodiments in which the invention may be practiced. These embodiments are described in sufficient detail to enable those skilled in the art to practice the invention. It is understood that other embodiments may be utilized without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
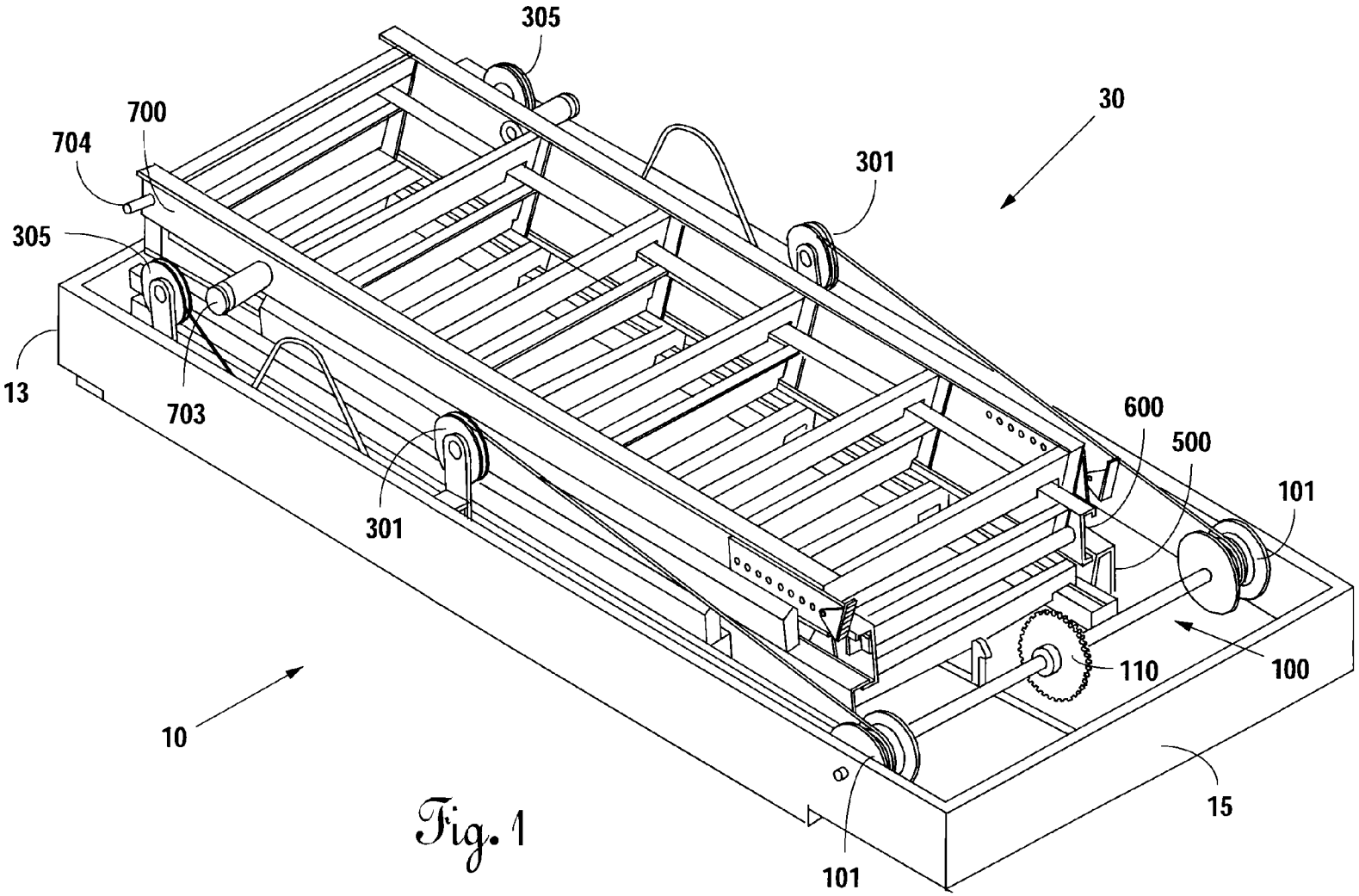
FIG. 1 is a perspective view of an access panel shown in its stowed position.
Figure 2:
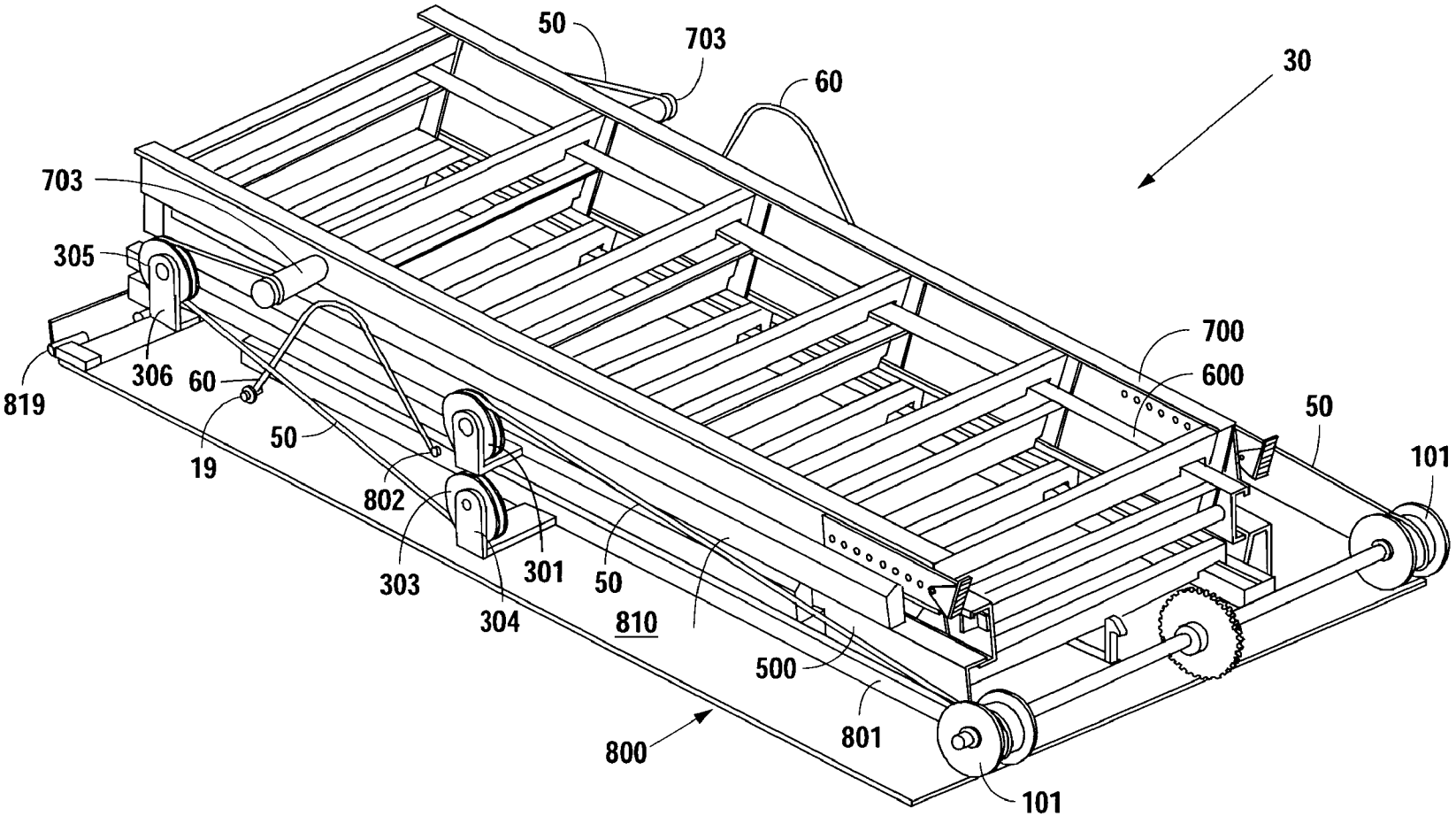
FIG. 2 is a perspective view of the access panel shown in FIG. 1 with the framing structure removed.

With reference to FIG. 1, the ladder sections 500, 600, 700 of access panel 30 are shown in their retracted and stowed position. The ladder sections 500, 600, 700 are mounted on a frame structure 10. With reference to FIG. 2 where the framing structure 10 is removed for clarity, the first ladder section 500 is spaced away from the inner surface 810 of the cover 800 by beams 801 mechanically attached to the cover 800. In this manner, the climbing of the steps of ladder 500 is not affected by the presence of the cover 800. In other words, the resting position of the feet of the user of the ladder portions of the access panel 30 remains the same whether the user is on ladder sections 700, 600 or 500. This allows each step of the ladder sections to have the same depth, and this provides to the user the same position of steps against his feet regardless of which section of the ladder he is standing on.

There are many manual retractable ladders that are commonly used in the industry, and more particularly in the construction industry. These ladders are composed of different sections that are arranged to slide on one another so that they can be extended and retracted. However, the steps of these ladders are usually composed of a plurality of rungs. Such a step configuration would be neither comfortable nor safe for everyone to use. Therefore, as shown on FIGS. 2, 8, 9, 10, and 11, all the steps have a comfortable width for the security of the person climbing of each of the sections. Alternatively, rungs could be used instead of the comfortable wide steps shown in FIGS. 2, 8, 9, 10 and 11.

With reference to FIG. 2 the ladder sections 500, 600, 700 are configured to allow a longitudinal sliding motion between each other. Section 500 is mechanically attached to cover 800 and spaced from it by beams 801. Section 600 is configured to slide longitudinally on top of, but inside, section 500. Section 700 is configured to slide longitudinally on top of, but outside, section 600. No further description of the sliding arrangement is made as this is a very well known and used in the industry.

Cover 800 that supports the ladder sections 500, 600, 700 is hinged via hinge 819 on forward end 13 of the framing structure 10 (See FIGS. 1 and 2). Since ladder section 500 is mechanically attached to cover 800, the hinge 819 can alternatively be installed between ladder section 500 and forward end 13 of framing structure 10.

Figure 3:
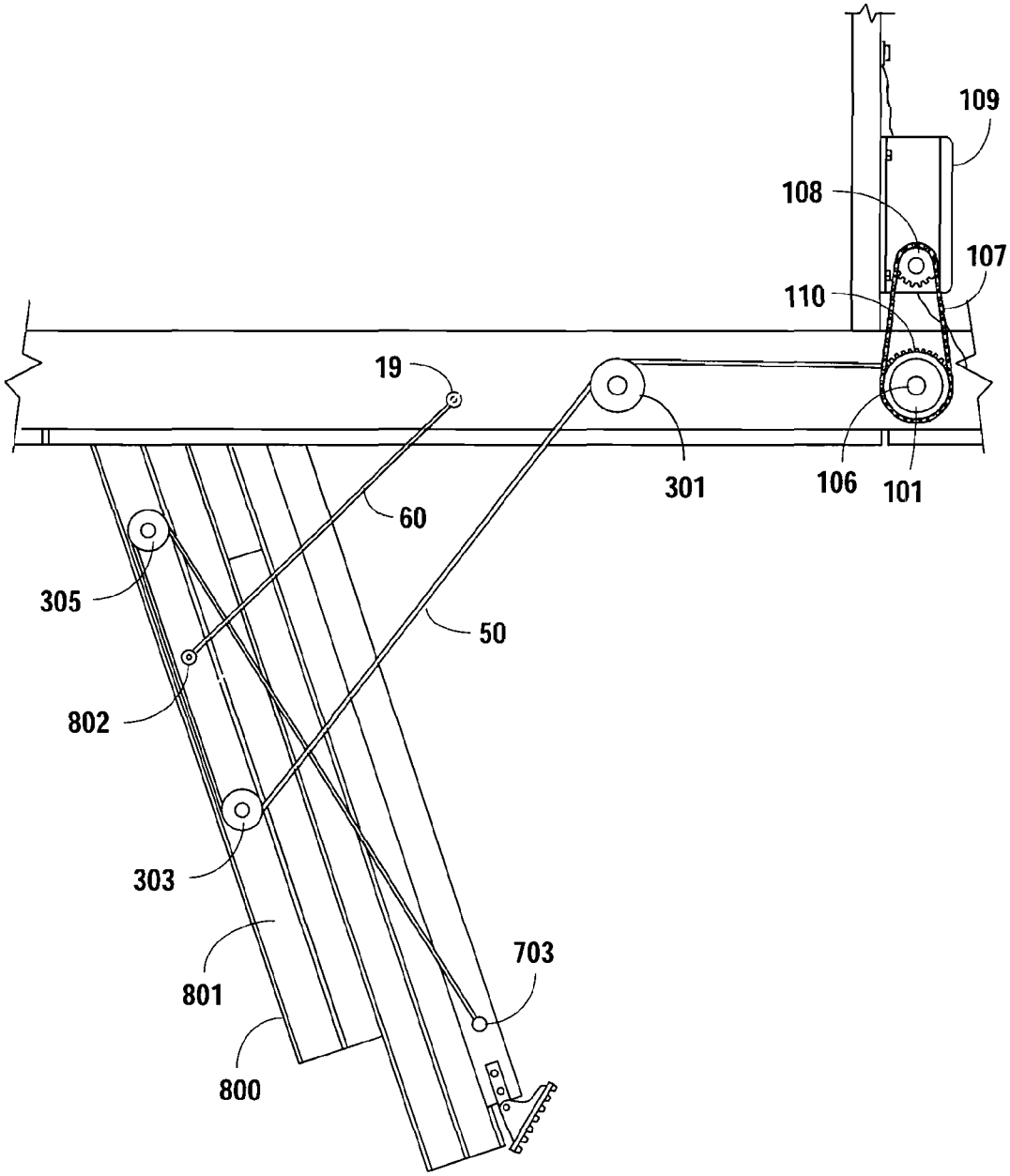
FIG. 3 is a side view of the access panel shown in the opened position, with sections of the ladder moving toward their retracted or extended position.

Still in reference to FIG. 2, the first ends of cables 50 are attached to reels 101 while the second ends of the cables 50 are attached to bars 703 of ladder section 700. Cables 50 are guided by pulleys 301 hinged on the framing structure 10 (See FIG. 1), pulleys 303 hinged on cover 800 and pulleys 305 hinged on ladder section 500. Alternatively, pulleys 305 may be hinged on beams 801. Clevis supports 304 of pulleys 303 are located such that the portion of the cables 50 that is guided by pulleys 301 and 303 is substantially vertical. This decreases the force required for the closing of the cover 800. Pulleys 305 are supported by clevis fittings 306 that are mechanically attached to either the forward portion of ladder section 500 or the forward portion of the cover 800. Retainer cables 60 have one end attached to bolts 19 that are mechanically attached to longitudinal sides 11 and 12 of framing support 10 (See FIG. 3). The other end of cables 60 is attached by fittings 802 to beams 801. Alternatively, fittings 802 may attach cables 60 directly to clevis 304 of pulley 303.

Figure 7:
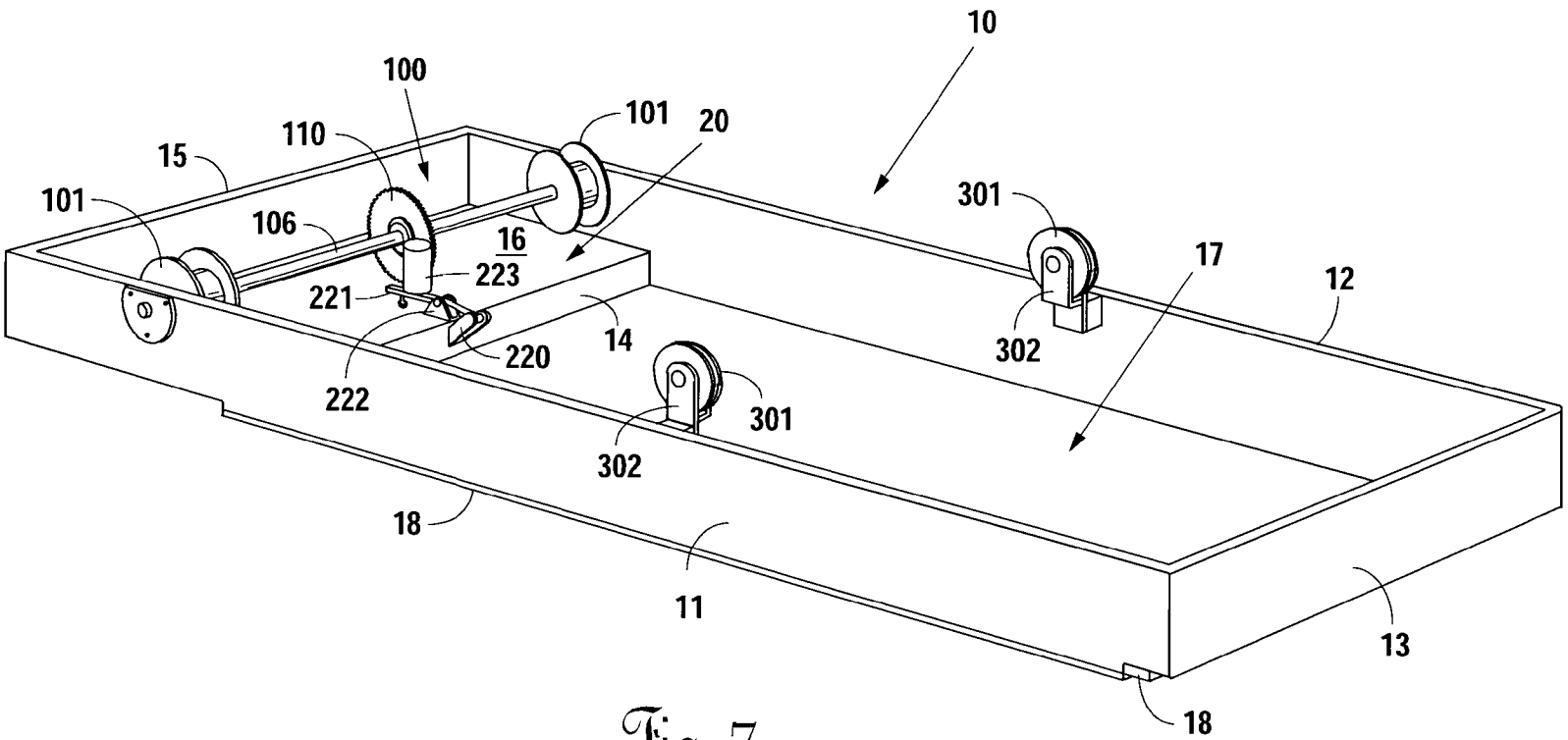
FIG. 7 is a perspective view of the framing structure and axle, without the access panel and ladder sections, and with an alternative solenoid operated stow latch.

With reference to FIG. 7, the framing structure 10 that supports the ladder sections 500, 600, 700 has a forward end 13, a intermediate distal end 14 and an aft end 15. The three ends 13, 14, 15 are bordered by two identical longitudinal opposite sides 11 and 12. There is a central through opening 17 disposed between the forward end 13 and intermediate distal end 14 and the longitudinal sides 11 and 12. There is no central through opening between intermediate distal end 14 and aft end 15 and the longitudinal sides 11 and 12; however, there is a cavity 20 that has a floor 16. This cavity 20 houses the latching system (as will be subsequently described), and the driving mechanism 100 of the invention. The longitudinal sides 11 and 12 support the axle 106 of driving mechanism 100, the brackets 302 which support pulleys 301, and the bolts 19 of the retainer cables 60 (FIG. 2). The lower faces of the longitudinal walls 11 and 12 and of the forward end 13 and intermediate distal end 14 are fitted with a seal 18 that is sandwiched by cover 800 when in its closed position. In this manner, should the access panel 30 be installed in a ceiling of a room that has an atmospheric controlled environment, energy loss is minimized.

Figure 8:
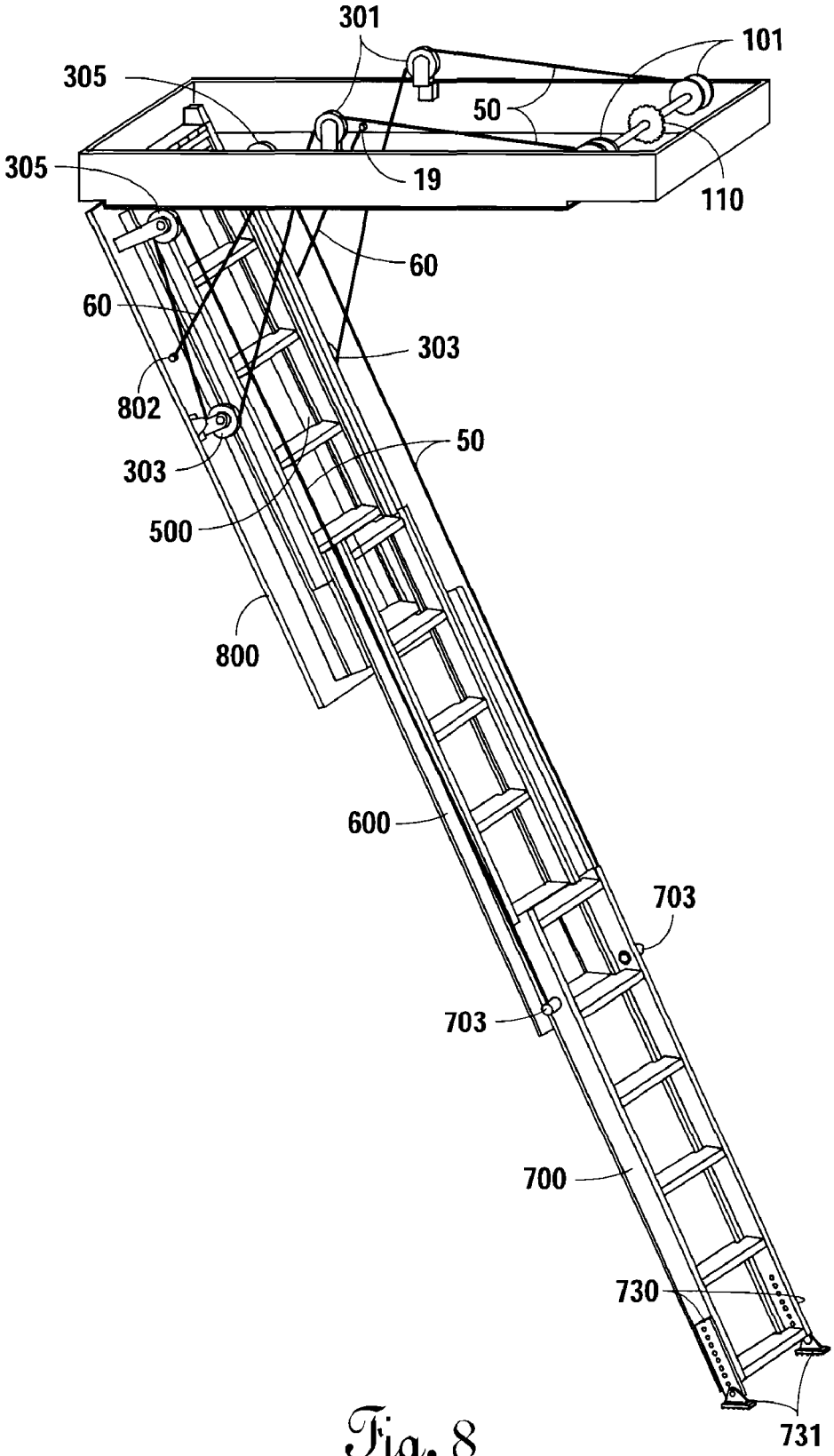
FIG. 8 is a perspective view of the access panel and ladder sections in their fully extended position.

With reference to FIG. 8, the cover 800 is shown in its full opened position. Cover 800 cannot open further because it is retained by cables 60. Operation of cables 50 with pulleys 301, 303 and 305 and reels 101 retract the ladder sections 600 and 700 and close the cover 800 as will be described herein below.

Starting with FIG. 1, the access panel 30 is retracted and closed or stowed. To initiate the opening of the cover 800 of the access panel 30, the stow latch 225 (See FIG. 6) must first be disengaged from the unlatch lever 221 (See FIG. 4). In the preferred embodiment, this is done mechanically by the user from the outside of the access panel by pulling a rope 151 which is connected to the unlatch lever 221, which pushes stow latch 225 and unlatches stow latch 225 from latch receptacle 220. Other embodiments are possible without changing the spirit of this invention, such as the use of a latch that is commonly used on doors (not shown). With this embodiment, the latch (not shown), which is a spring loaded latch, engages a latch receptacle as is commonly found in a door frame (not shown). Pulling the rope 151 retracts the latch (not shown) into its housing, and consequently the latch disengages the latch receptacle (not shown).

In an alternative embodiment, the user could press a switch (not shown) outside the access panel 30 (i.e. in the living area) for energizing of a solenoid 223 that has its piston rod (not shown) spring loaded in the retracted position. This action extends the piston rod (not shown) of the solenoid 223 which then pivots the unlatching lever 221 of stow latch 225 towards its unlatched position (See FIG. 7).

Figure 4:
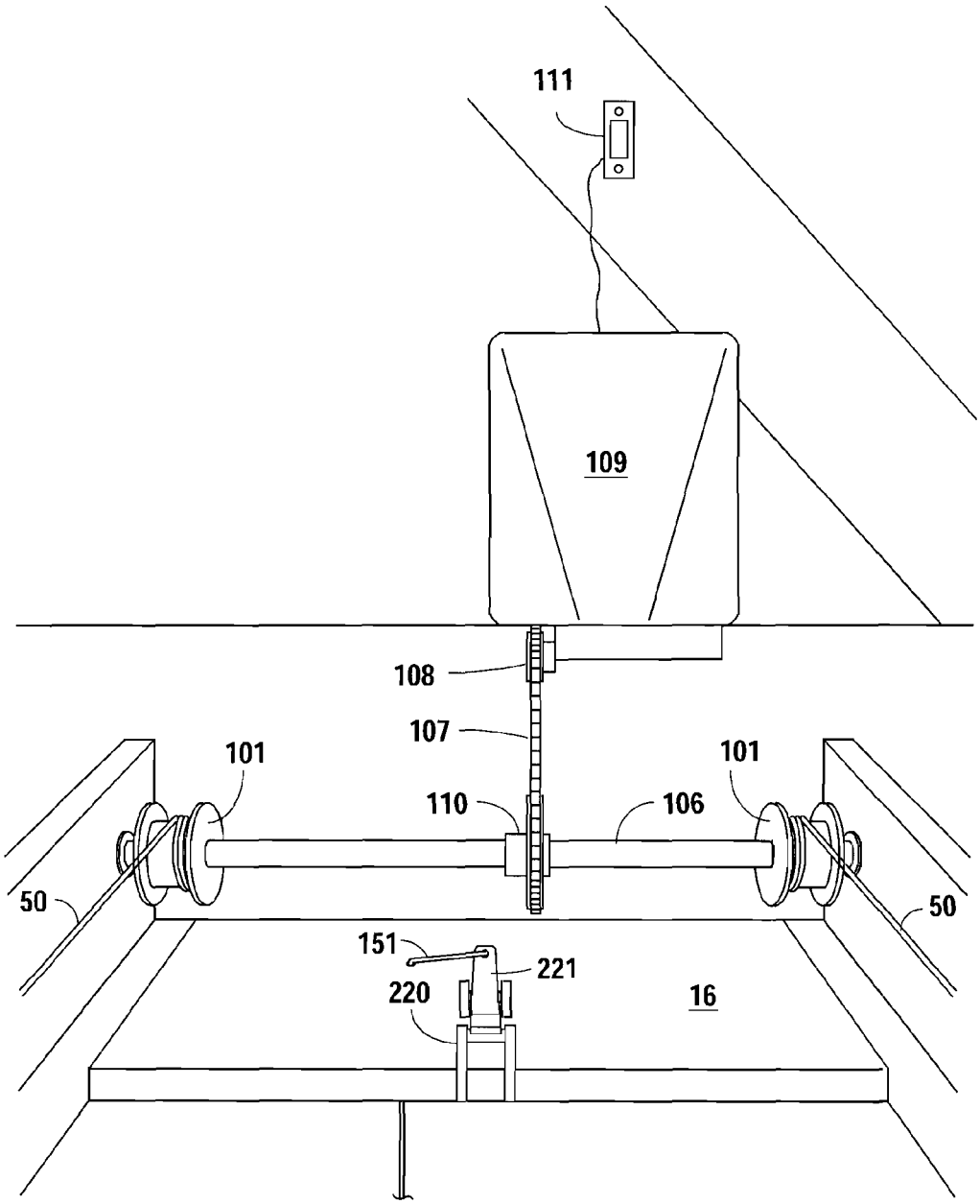
FIG. 4 is a front view of the raising and lowering mechanism of the present invention.
Figure 6:
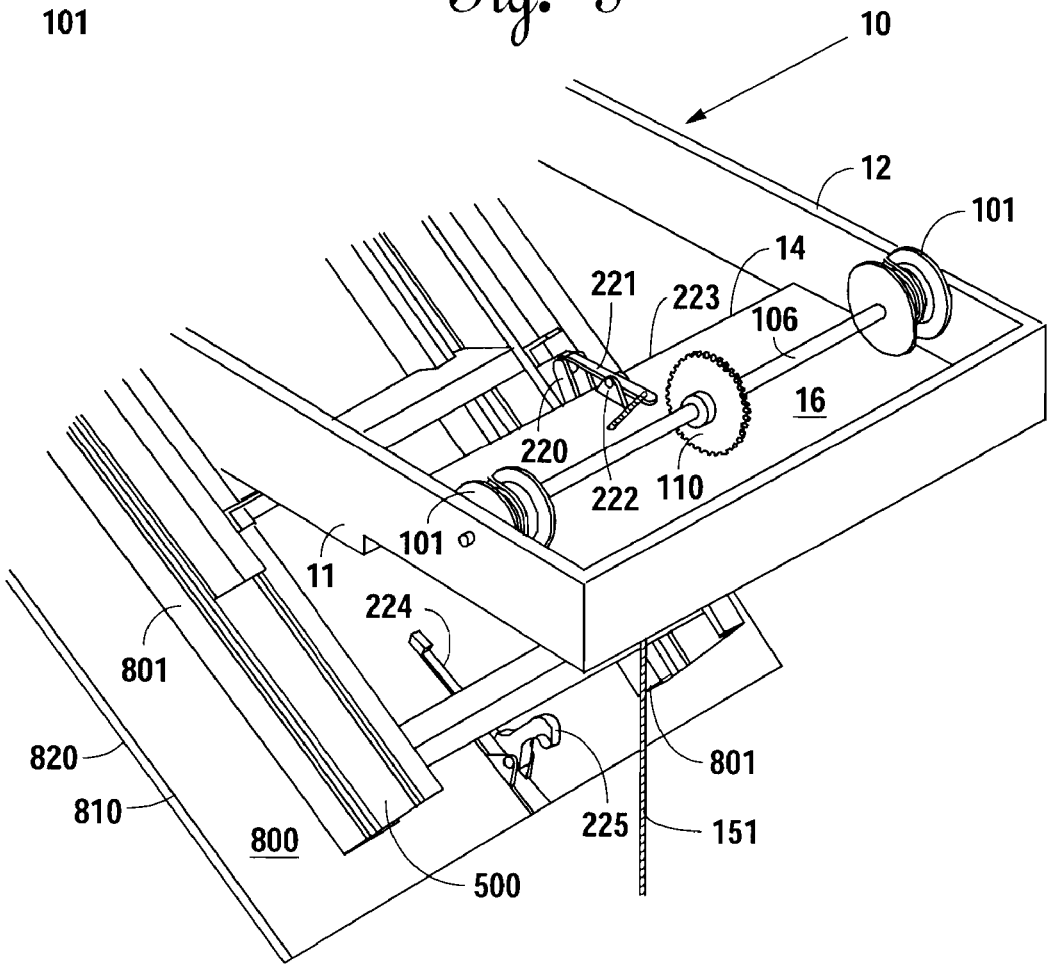
FIG. 6 is a partial perspective view of the access panel partially opened, showing the stow latch.

As best shown in FIGS. 4 and 6, the unlatch lever 221 disengages stow latch 225 from its latch receptacle 220 mounted on the intermediate distal end 14 of the framing structure 10. Once the stow latch 225 is disengaged, gravity causes the cover 800 to move a short distance away from its latched position. However, cover 800 is prevented from moving past the short distance by the gears 108 of the energizing motor 109 that has not yet been energized. The gears 108 of the motor 109 prevent the chain 107 from moving the free wheel 110 until and unless the motor 109 is energized to rotate the gears in a lowering direction. This effectively locks the axle 106 from rotating in a lowering direction. This prevents the cover 800 and the stowed ladder sections 500, 600 and 700 from free falling after the stow latch is unlatched, but before opening the cover 800 and deploying the ladder sections 600 and 700.

Referring to FIGS. 6 and 8, once stow latch 225 is released, the switch (not shown) outside the access panel 30 is operated to energize the motor to control the rotational speed of the free wheel 110, hence the rate of the opening of the access panel and gravitational deployment of the ladder sections from the partially opened position of FIG. 6 to the fully opened and deployed position of FIG. 8. The motor 109 is energized via a switch (not shown) in the living area that closes the circuit of the electrical connections of the motor 109 to an electrical power source (not shown). No further description of this is provided as this is very well known in the art. The switch that energizes the motor 109 is preferably not an ON-OFF switch, but a switch that needs to be pressed and maintained pressed by the user to open the cover 800 and lower ladder sections 600 and 700. This is a safety characteristic of the invention, as the access panel 30 cannot accidentally fully open and fully extend unless the user has decided to do so. For example, this prevents the full opening of the access panel 30 and extension of the ladder sections 600 and 700, should the switch be accidentally energized by bumping into or brushing up against the switch, or if it is otherwise accidentally and momentarily energized by a child or anyone else. However, alternatively, if such a safety mechanism is not desirable to the user, an ON/OFF switch could be used. As another safety feature of the present invention, an emergency switch 111 (See FIG. 4) to energize the motor 109 can be placed inside the attic. This would allow activation of the motor 109 to open the access panel and extend the ladder from inside the attic, should a user become trapped inside the attic space due to closure of the access panel 30.

Figure 5:
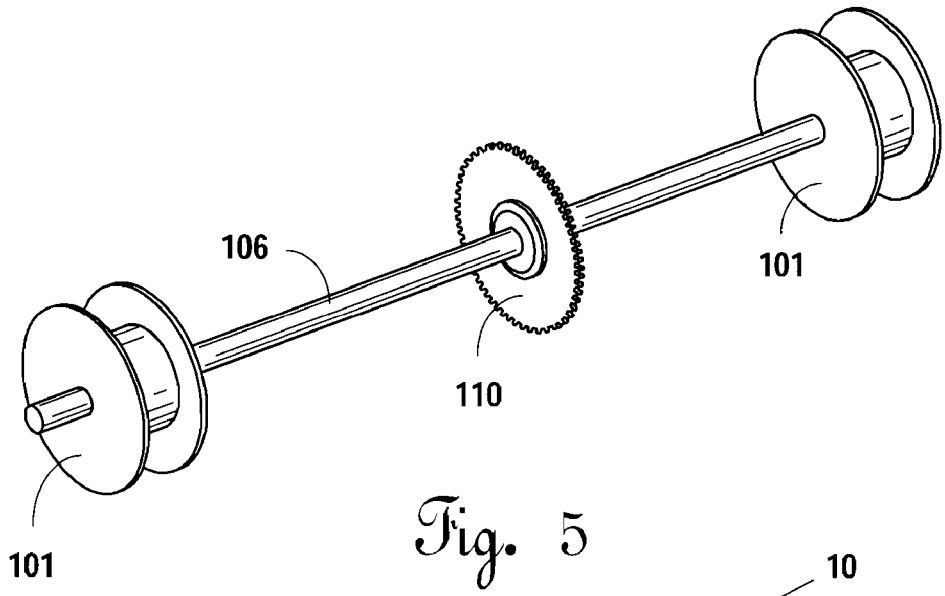
FIG. 5 is an enlarged perspective view of a portion of the apparatus for unrolling and rolling up the cables.

Referring to FIG. 5, the axle 106 of the present invention is shown. Connected to the axle 106 is the free wheel 110, which has a sprocket along its outer circumference. On the each distal end of the axle 106 are corresponding reels 101, to which cables 50 attach at their first ends. As best shown in FIG. 4, a chain 107 attaches to the sprockets of the free wheel 110 and to the gear 108 of the motor 109. As shown, the motor 109 of the present invention is located in close proximity to, but remotely from cavity 20. Alternatively, the motor 109 could be located on the floor 16 of the cavity 20 of the present invention. As best shown in FIGS. 6 and 7, the axle 106 is attached to the longitudinal sides 11 and 12 inside the cavity 20 such that the reels 101 rest inside longitudinal walls 11 and 12.

Referring to FIG. 4, by operation of the switch, the motor 109 is energized such that the gear 108, which is mounted on the shaft of the motor 109 rotates in a lowering direction. A chain 107 connects the gear 108 to the sprocket attached to the free wheel 110. Thus, as the gear 108 is rotated in a lowering direction, the chain 107 rotates the free wheel 110 and controls its rotational speed. Gravity alone, via the cables 50, drives the reels 101 and hence the shaft 106. Shaft 106 drives the free wheel 110 via the sprocket. The rotational speed of the free wheel 110 is controlled via the chain 107 by the gear 108 of the motor 109, thereby controlling the rotational speed of the shaft 106 to which the free wheel 110 is attached. This causes the reels 101 to control the rate of unrolling of the cables 50, which allows gravity to fully open the cover 800 and lower the ladder sections 500, 600, 700. Energization of the motor 109 controls the rotational speed of the shaft 106 and the reels 101 which in turn control the rate of gravity. Gravity alone causes the unrolling of the cables 50 until the access panel 30 is fully opened, and the ladder sections 600 and 700 are fully deployed to the position shown in FIG. 8. Cover 800 has cables 60 to limit the opening of the panel access 30 to a predetermined angle typically ranging between 60 and 70 degrees. During this phase of the opening, it is gravity alone that unrolls the cables 50 from their reels 101. However, the rate of the gravitational force in opening the access panel 30 and lowering the ladder sections 600 and 700 is controlled by energization of the motor 109 in the lowering direction.

Gravity's effect on ladder sections 600 and 700 continues to unroll cables 50 from reels 101 until the ladder sections 600 and 700 reach the position shown in FIG. 8. The stops 603 of ladder section 600 (See FIG. 10) rest on step 740 of ladder section 700, so that when ladder section 700 is deployed from its stowed position over ladder section 500, ladder section 600 follows in unison with ladder section 700. In the position of FIG. 8, the stops 602 of ladder section 600 (See FIG. 10) rest on the stops 502 of ladder section 500 (See FIG. 9) and, consequently, ladder section 600 has reached its fully extended position.

Figures 9, 10, 11:
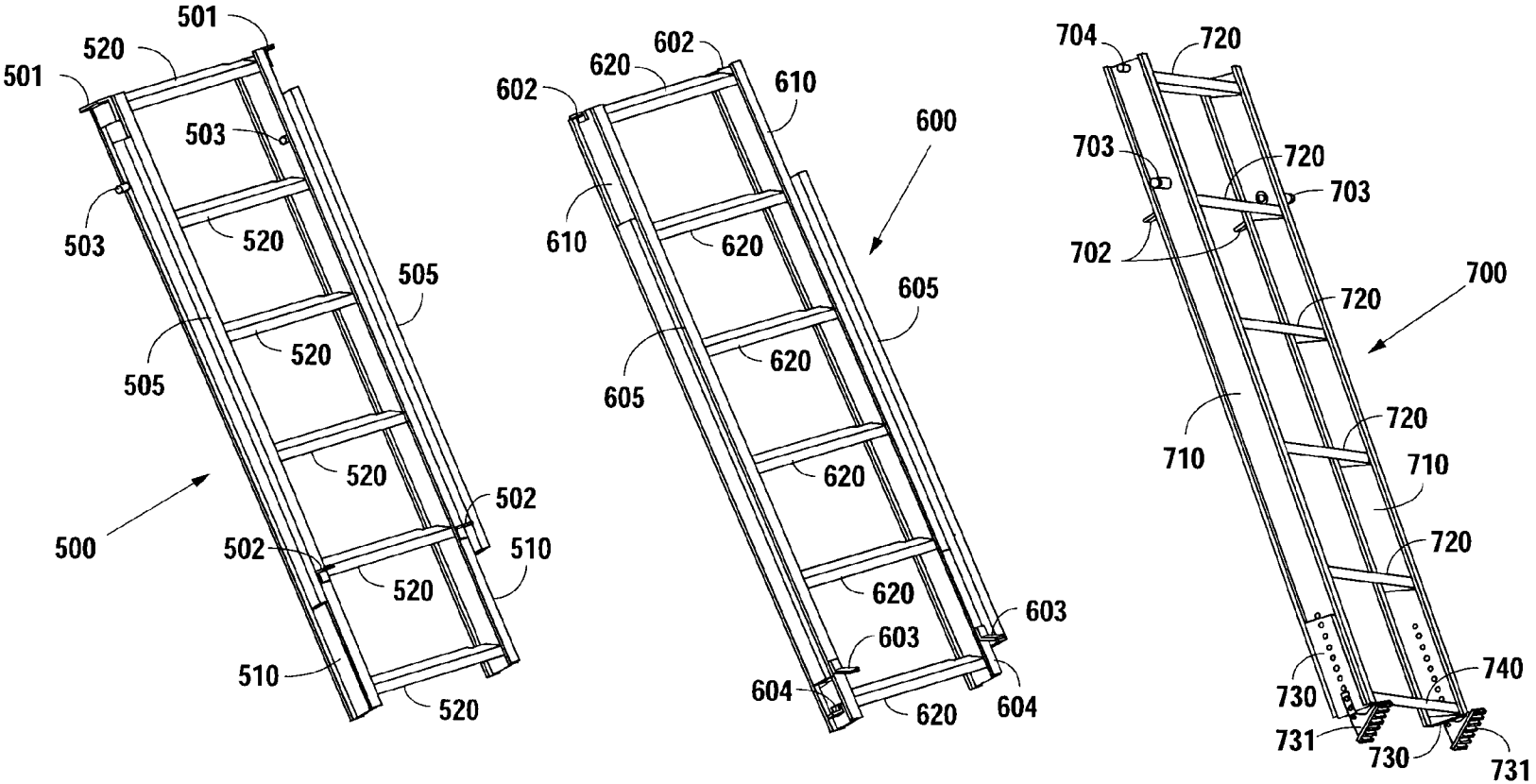
FIG. 9 shows perspective view of the first ladder section.
FIG. 10 shows a perspective view of the second ladder section.
FIG. 11 shows a perspective view of the third ladder section.

Gravity's effect of ladder section 700 continues to unroll cables 50 from their reels 101 until stops 702 reach stops 604 of ladder section 600 (See FIGS. 10 and 11). In this position the ladder sections 500, 600 and 700 have reached their fully extended position shown in FIG. 8. As shown in FIGS. 8 and 11, ladder section 700 is equipped with adjustable legs 730, fitted with rotating shoes 731 to ensure perfect contact with the ground when the ladder sections are fully extended. Furthermore, rotating shoes 731 provide a soft, nonabrasive contact with the floor to protect the floor from scarring, or carpet from tearing when the latter section 700 contacts the floor. Alternatively, ladder section 700 could be of a predetermined length, eliminating adjustable legs 730. Likewise, rotating shoes 731 may be eliminated as well.

As previously described, the opening of the cover 800 and the extending of the ladder sections 500, 600, 700 is only achieved through gravity, the rate of which is controlled by the energizing motor 109. The retraction of the ladder sections 500, 600, 700 and the closing of the cover 800 is achieved via the assistance of the motor 109. Starting from the position shown in FIG. 8, the motor 109 is energized via the switch (not shown) in the living area. Gear 108 mounted on the shaft of the motor 109 drives the chain 107 that is connected to the free wheel 110. The free wheel 110, via the sprocket, drives the shaft 106 and the reels 101 in a raising direction, causing cables 50 to roll around their respective reels 101.

The motorized drive of the free wheel 110 in the raising direction rolls up the cables 50 on their respective reels 101 until the ladder section 700 overlaps ladder section 600 such that step 740 of ladder section 700 (See FIG. 11) meets with stops 603 of ladder section 600 (See FIG. 10). Thereafter, further reeling in of cables 50 in the raising direction further retracts ladder section 700 and pulls with it ladder section 600 towards their retracted position. At such point where the ladder sections 500, 600, 700 are fully retracted, the cover 800 is ready to be closed by the further rolling up of the cables 50 on their reels 101 to reach the closed position. When the cover 800 is approaching the closed position, stow latch 225, via spring 224, meets its latch receptacle 220 (See FIG. 6) forcing stow latch 225 to re-engage its receptacle 220. The motor continues to pull the panel 30 passed its normally closed position a very short distance until the panel 30 meets with the frame 10. At such time, since the panel 30 cannot be raised any further, and because the electric load on the motor 109 is higher than a pre-set threshold, the motor 109 reverses its direction of rotation briefly, which allows gravity alone to pull the panel 30 downward. The panel 30 is prevented from lowering by the engagement of the latch 225 that has re-engaged the receptacle 220 as explained herein above. The motor 109 may continue to drive the freewheel in the lowering direction, but the shaft 106 no longer turns since gravity's effect on the shaft 106 is prevented by the re-latching of the panel 30. Once the access panel 30 is fully re-latched, it is in the configuration shown on FIGS. 1 and 2 and the electric motor 109 can be automatically de-energized in several ways, such as a time delay built in its electronic circuit, an impulse applied to the control switch (not shown), electrical load currents, or any other means known in the industry.

In reference to FIGS. 9, 10, and 11 ladder sections 500, 600, 700 are respectively fitted with a series of steps 520, 620, 720 that provides comfort and safety to the user. For instance the steps 520, 620, 720 may be covered with a non slippery surface. In addition for ease of climbing, ladder sections 500, 600 are respectively fitted with railing 505, 605 (See FIGS. 9 and 10).

The invention uses only the motor 109 to retract the ladder sections 500, 600, 700 and close the cover 800. The invention further uses the motor 109 and the free wheel 110 with a sprocket to control the rate of deployment of the panel and the ladder sections 500, 600 and 700 as previously described.

We claim:

1. An automated ladder apparatus to provide access to a space above an elevated structure, the automated ladder apparatus comprising:

a cover for an opening in said elevated structure, said cover being moveable between a first position to allow access to the space through the opening and a second position in which the cover substantially covers, said opening;

a plurality of slidably extendable ladder sections, a first of said slidably extendable ladder sections being slidable with respect to a second of said slidably extendable ladder sections;

a motor configured to rotate a first gear;

a reel coupled to at least one of said plurality of said slidably extendable ladder sections via a cable; and a free wheeling gear coupled to said first gear and said reel, said free wheeling gear (a) allowing for gravity to rotate said reel to unwind said cable about said reel so as to open said cover and lower said cover and extend said plurality of said slidably extendable ladder sections, wherein, during extension of said plurality of said slidably extendable ladder sections, said motor is energized to rotate said first gear to control a rotational speed of said reel, and (b) allowing for said first gear to continue to rotate when said reel is prevented from rotating to unwind said cable.

2. The automated ladder apparatus of claim 1, wherein said first gear is connected to said free wheeling gear via a chain.

3. The automated ladder apparatus of claim 1, further comprising a latching mechanism configured to hold said cover in a closed position.

4. The automated ladder apparatus of claim 3, wherein said latching mechanism is adapted to be operated manually.

5. The automated ladder apparatus of claim 3, wherein said latching mechanism is automatically re-latched when said cover is closed.

6. The automated ladder apparatus of claim 3, wherein opening of the cover and extension of said plurality of said slidably extendable ladder sections is effected by unlatching the latching mechanism first, allowing gravity to pivot said cover over a distance, and as a result of the cover moving the distance, the motor is energized to control a speed at which said cover pivots and said plurality of said slidably extendable ladder sections extend.

7. The automated ladder apparatus of claim 3, wherein said motor is adapted to exert a pulling force on said cover after said cover is held in the closed position by said latching mechanism to force a load of said motor to go beyond a threshold, which forces said motor to reverse a direction of rotation of said first gear.

8. The automated ladder apparatus of claim 7, wherein, subsequent to reversing the direction of rotation, said motor is de-energized after a pre-determined amount of time.

9. The automated ladder apparatus of claim 3, wherein said reel is prevented from rotating when said cover is held in a closed position by said latching mechanism.

10. The automated ladder apparatus of claim 1, wherein said cable is directed through pulleys so that said cable is substantially vertical when closing said cover to exert a maximum lifting force on said cover.

11. The automated ladder apparatus of claim 1, further comprising a framing structure designed to be installed into said opening and a seal between said cover and said framing structure to create an environmental seal around said opening in said ceiling.

12. The automated ladder apparatus of claim 1, wherein said plurality of slidably extendable ladder sections comprises at least one stop on a lower end of said first of said slidably extendable ladder sections; and at least one corresponding stop on an upper end of said second of said slidably extendable ladder sections; wherein said at least one corresponding stop on said second of said slidably extendable ladder sections contacts said at least one stop on said first of said slidably extendable ladder sections when said second of said slidably extendable ladder sections is fully extended with respect to the first of said slidably extendable ladder sections.

13. The automated ladder apparatus of claim 1, said free wheeling gear allowing for said motor to rotate said reel to wind up said cable about said reel which retracts said plurality of said slidable extendable ladder sections.

14. The automated ladder apparatus of claim 1, wherein said free wheeling gear includes a first part coupled to said reel and a second part coupled to said first gear, said second part being driven by said first gear during extension of said plurality of said slidably extendable ladder sections and said second part being adapted to freely rotate relative to said first part when said first part is prevented from rotating.

15. The automated ladder apparatus of claim 14, wherein, during extension of said plurality of said slidably extendable ladder sections, a rotational speed of said first gear controls a rotational speed of said second part which, in turn, controls a rotational speed of said first part and the rotational speed of said reel.

16. The automated ladder apparatus of claim 14, wherein said first part is adapted to engage said second part when said motor drives said second part to wind up said cable about said reel which retracts said plurality of said slidable extendable ladder sections.

17. The automated ladder apparatus of claim 14, wherein said first part is adapted to engage said second part via a sprocket mechanism of the freewheeling gear.

18. The automated ladder apparatus of claim 1, wherein said elevated structure is a ceiling.

19. The automated ladder apparatus of claim 1, wherein aid first gear is, part of a gearing arrangement of said motor that is configured to control a rate of lowering of said plurality of slidably extendable ladder sections.

20. An automated ladder apparatus to provide access to a space above an elevated structure, the automated ladder apparatus comprising:

a cover for an opening in said elevated structure, said cover being moveable between a first position to allow access to the space through the opening and a second position in which the cover substantially covers said opening;

a plurality of slidably extendable ladder sections, a first of said slidably extendable ladder sections being slidable with respect to a second of said slidably extendable ladder sections;

a motor;

a reel coupled to at least one of said plurality of said slidably extendable ladder sections via a cable;

a latching mechanism configured to hold said cover in the closed position; and a free wheeling gear coupled to said motor and said reel, said free wheeling gear (a) allowing for gravity to rotate said reel to unwind said cable about said reel and move said cover once said latching mechanism is unlatched, and (b) allowing for said reel to be driven by said motor to wind up said cable about said reel which retracts said plurality of said slidable extendable ladder sections, moves said cover toward the second position and then re-latches said latching mechanism to hold said cover in the second position.

21. The automated ladder apparatus of claim 20, wherein said motor is energized to control a rotational speed of said reel during extension of said plurality of said slidably extendable ladder sections.

22. The automated ladder apparatus of claim 20, wherein said motor is energized after said cover pivots over a distance due to gravity.

23. The automated ladder apparatus of claim 20, wherein said motor is adapted to rotate a first gear coupled to the free wheeling gear to wind up said cable about said reel, said motor further adapted to exert a pulling force on said cover after said cover is held in the closed position by the latching mechanism to force a load of said motor to go beyond a threshold, which forces said motor to reverse a direction of rotation of said first gear.

24. The automated ladder apparatus of claim 20, wherein said free wheeling gear includes a first part coupled to said reel and a second part coupled to said motor, said second part being adapted to freely rotate relative to said first part when said first part is prevented from rotating.

25. The automated ladder apparatus of claim 24, wherein said second part is driven by said motor during extension of said plurality of said slidably extendable ladder sections to control a rotational speed of said first part and said reel.

26. An automated ladder apparatus to provide access to a space above an elevated structure, the automated ladder apparatus comprising:

a cover for an opening in said elevated structure, said cover being moveable between a first position to allow access to the space through the opening and a second position in which the cover substantially covers said opening;

a plurality of slidably extendable ladder sections, a first of said slidably extendable ladder sections being slidable with respect to a second of said slidably extendable ladder sections;

a reel coupled to at least one of said plurality of said slidably extendable ladder sections via a cable; and a free wheel coupled to a motor and said reel, said free wheel (a) allowing for gravity to rotate said reel to unwind said cable about said reel so as to open said cover and lower said cover and extend said plurality of said slidably extendable ladder sections, and (b) allowing for said motor to continue to drive said free wheel when said reel is prevented from rotating to unwind said cable.

27. The automated ladder apparatus of claim 26, wherein said free wheel includes a first part coupled to said reel and a second part coupled to said motor and wherein said second part is adapted to freely rotate relative to the first part when said reel and said first part are prevented from rotating.

28. The automated ladder apparatus of claim 26, comprising a latching mechanism adapted to hold said cover in a closed position, thereby preventing said reel from rotating to unwind said cable to open said cover.

29. An automated ladder apparatus to provide access to a space above an elevated structure, the automated ladder apparatus comprising:

a plurality of slidably extendable ladder sections coupled to said elevated structure, a first of said slidably extendable ladder sections being slidable with respect to a second of said slidably extendable ladder sections, said plurality of slidably extendable ladder sections allowing access to the space through an opening in said elevated structure;

a motor configured to rotate a first gear;

a reel coupled to at least one of said plurality of said slidably extendable ladder sections via a cable; and a free wheel coupled to said first gear and said reel, said free wheel (a) allowing for gravity to rotate said reel to unwind said cable about said reel so as to lower and extend said plurality of said slidably extendable ladder sections, wherein, during extension of said plurality of said slidably extendable ladder sections, said motor is energized to rotate said first gear to control a rotational speed of said reel, and (b) allowing for said first gear to continue to rotate when said reel is prevented from rotating to unwind said cable.

30. The automated ladder apparatus of claim 29, comprising a cover for said opening, said cover being moveable between a first position to allow access to the space through the opening and a second position in which the cover substantially covers said opening, wherein said plurality of slidably extendable ladder sections are mounted on said cover.

31. The automated ladder apparatus of claim 30, comprising a framing structure arranged in said elevated structure, wherein said cover is hingedly mounted on said framing structure.

32. The automated ladder apparatus of claim 30, said free wheel allowing for said motor to rotate said reel to wind up said cable about said reel which retracts said plurality of said slidable extendable ladder sections.

33. An automated ladder apparatus to provide access to a space above an elevated structure, the automated ladder apparatus comprising:

a plurality of slidably extendable ladder sections coupled to said elevated structure, a first, of said, slidably extendable ladder sections being slidable with respect to a second of said slidably extendable ladder sections, said plurality of slidably extendable ladder sections allowing access to the space through an opening in said elevated structure;

a reel coupled to at least one of said plurality of said slidably extendable ladder sections via a cable; and a free wheel coupled to a motor and said reel, said free wheel (a) allowing for gravity to rotate said reel to unwind said cable about said reel so as to lower and extend said plurality of said slidably extendable ladder sections, and (b) allowing for said motor to continue to drive said free wheel when said reel is prevented from rotating to unwind said cable.

34. The automated ladder apparatus of claim 33, comprising a cover for said opening, said cover being moveable between a first position to allow access to the space through the opening and a second position in which the cover substantially covers said opening, wherein said plurality of slidably extendable ladder sections are mounted on said cover.

35. The automated ladder apparatus of claim 34, comprising a framing structure arranged in said elevated structure, wherein said cover is hingedly mounted on said framing structure.

36. The automated ladder apparatus of claim 34, said free wheel allowing for said motor to rotate said reel to wind up said cable about said reel which retracts said plurality of said slidable extendable ladder sections.

* * * * *